US006910593B1

(12) United States Patent
Moore

(10) Patent No.: US 6,910,593 B1
(45) Date of Patent: Jun. 28, 2005

(54) PORTABLE GARMENT RACK

(76) Inventor: Barry A. Moore, 981 Kiefer Trails Dr., Ballwin, MO (US) 63021

( * ) Notice: Subject to any disclaimer, the term of this patent is extended or adjusted under 35 U.S.C. 154(b) by 4 days.

(21) Appl. No.: 10/789,098

(22) Filed: Feb. 27, 2004

(51) Int. Cl.[7] ..... A47F 7/24
(52) U.S. Cl. ..... 211/85.3
(58) Field of Search ..... 211/85.3, 203, 211/204, 198, 186; 297/188.08, 188.02

(56) References Cited

U.S. PATENT DOCUMENTS

| | | | | |
|---|---|---|---|---|
| 1,176,563 | A | 3/1916 | Johnson | |
| 1,525,701 | A | 2/1925 | Rose et al. | |
| 1,804,069 | A * | 5/1931 | Stover | 211/85.3 |
| 3,807,574 | A | 4/1974 | Lanza | |
| 4,253,578 | A * | 3/1981 | Rekow | 211/208 |
| 4,892,279 | A | 1/1990 | Lafferty et al. | |
| 5,370,248 | A * | 12/1994 | Robolin | 211/189 |
| 5,570,795 | A * | 11/1996 | Colgrove | 211/187 |
| 5,617,962 | A | 4/1997 | Chen | |
| 5,718,344 | A | 2/1998 | Joldeson et al. | |
| 5,752,611 | A | 5/1998 | Nakagawa | |
| 5,819,961 | A * | 10/1998 | Harris | 211/196 |
| 6,213,434 | B1 | 4/2001 | Reichanadter, Jr. | |
| 6,367,749 | B2 * | 4/2002 | Valiulis | 248/188 |
| 6,382,434 | B1 | 5/2002 | Silberg | |
| 6,523,707 | B2 | 2/2003 | Liu | |
| 6,749,073 | B2 * | 6/2004 | McNab | 211/85.3 |

* cited by examiner

*Primary Examiner*—Peter M. Cuomo
*Assistant Examiner*—Sarah Purol
(74) *Attorney, Agent, or Firm*—Douglas E. Warren

(57) ABSTRACT

The present invention relates to a portable garment rack that allows for storage of grooming items, other small items, and accessories, and clothes at a temporary location. The portable garment rack includes an upper hanger bar and an intermediate hanger bar for hanging clothes. An upper accessory shelf and a flexible intermediate accessory shelf are also provided for storing various loose articles. The portable garment rack can be collapsed to a small size for storage and transportation, and then reassembled at a remote location.

20 Claims, 5 Drawing Sheets

PORTABLE GARMENT RACK

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

Some occupations and hobbies require that individuals change their attire during the time they are engaged in their efforts. For example, entertainers and recitalists are often required to change costumes, makeup, or both during various periods of their performances. While larger entertainment halls sometimes provide dressing rooms or facilities that allow for the storage of costumes and grooming articles, those facilities are rarely found in the vast majority of performance sites. As a result, entertainers performing at those limited venues where facilities are sparse, are unable to adequately store their costumes and grooming articles in a way that is efficient and convenient.

Such devices are generally known as "costumers" and several designs have been offered for various types of garment racks that have varying degrees of transportability or utility. For example, U.S. Pat. No. 3,807,574 offers one type of costumer. While the device disclosed in that patent is identified as a costumer, there are a number of deficiencies that do not fulfill all of the needs of the user. The design of this invention does not locate the center of gravity in a manner that enhances the ability of the invention to remain upright when loaded with heavy articles. Additionally, there are limited numbers of hanging devices for clothing and there is no component at all that provides any storage for grooming articles, small items, or other accessories. Finally, there is very little transportability of the device.

U.S. Pat. No. 5,370,248 also discloses an adjustable garment rack. While the device has some telescoping features that generally provide for some limited portability, the device lacks any kind of tray or component that would allow for the placement and storage of any types of grooming articles, small items, or other accessories. The base of the invention does not appear to be collapsible making transportability problematic for this invention.

U.S. Pat. No. 5,819,961 discloses a garment rack that can be collapsed for transportation or storage. When assembled the rack has four short legs that protrude from a central vertical support assembly that is hinged near the center to allow the vertical support to be folded. The rack includes two shoulder members that fold away from the central vertical support assembly to allow for the hanging of an upper garment such as a shirt, blouse, or jacket. An additional hanger extension having a number of serrated edges is also foldabley extended from the central vertical support to allow for the hanging of a number of garment hangers similar to a standard coat hanger. Another extension head telescopes from the upper end of the central vertical support to allow for additional hanging of garments. However, the invention does not disclose a tray of any kind for storing miscellaneous grooming items such as combs, brushes, small items, or other accessories, etc. Additionally, the design of this invention does not locate the center of gravity in a manner that enhances the ability of the invention to remain upright when loaded with heavy articles.

U.S. Pat. No. 1,525,701 also discloses a garment rack that is portable and collapsible. The rack consists of a central vertical support, three lower folding legs, a number of coat hooks near the upper end of the central vertical support, and an array of hanging rods at the upper end of the central vertical support. However, as with the other above inventions, the invention does not disclose a tray of any kind for storing miscellaneous grooming items such as combs, brushes, small items, or other accessories, etc.

The device in U.S. Pat. No. 1,176,563 also discloses a garment rack. The rack includes a foldable central vertical support, three foldable lower legs, a trouser hanging rod, and an upper garment hanging rod. Once again, however, the invention does not disclose a tray of any kind for storing miscellaneous grooming items such as combs, brushes, small items, or other accessories, etc.

As can be seen, all of the devices shown in these patents offer some type of portable garment rack for hanging clothes, however, none of these devices fulfill all the needs of an entertainer.

SUMMARY OF THE INVENTION

The present invention overcomes these and other problems by providing a garment rack capable of hanging short or folded apparel, hanging long apparel such as dresses, holding loose items such as bracelets, lipstick, combs, or change, holding makeup or toiletry kits, holding ties, hats, or belts, and which is also lightweight and collapsible in a manner that enhances its portability.

The present invention resides in a portable garment rack having folding and telescoping legs that, when assembled, provides multiple methods for hanging garments, and provides both flat solid surfaces and flexible surfaces that can be used to store loose items. The design of the present invention allows it to be collapsed into a relatively small package that, through the use of light weight hollow tubing for the supporting legs, is also easy to carry.

Additional features of the present invention will be in part apparent and in part pointed out hereinafter.

BRIEF DESCRIPTION OF THE SEVERAL VIEWS OF THE DRAWINGS

Corresponding reference characters indicate corresponding parts throughout the several views of the drawings.

While one embodiment of the present invention is illustrated in the above referenced drawings and in the following description, it is understood that the embodiment shown is merely for purpose of illustration and that various changes in construction may be resorted to in the course of manufacture in order that the invention may be utilized to the best advantage according to circumstances which may arise, without in any way departing from the spirit and intention of the invention, which is to be limited only in accordance with the claims contained herein.

DETAILED DESCRIPTION

Figure 1:
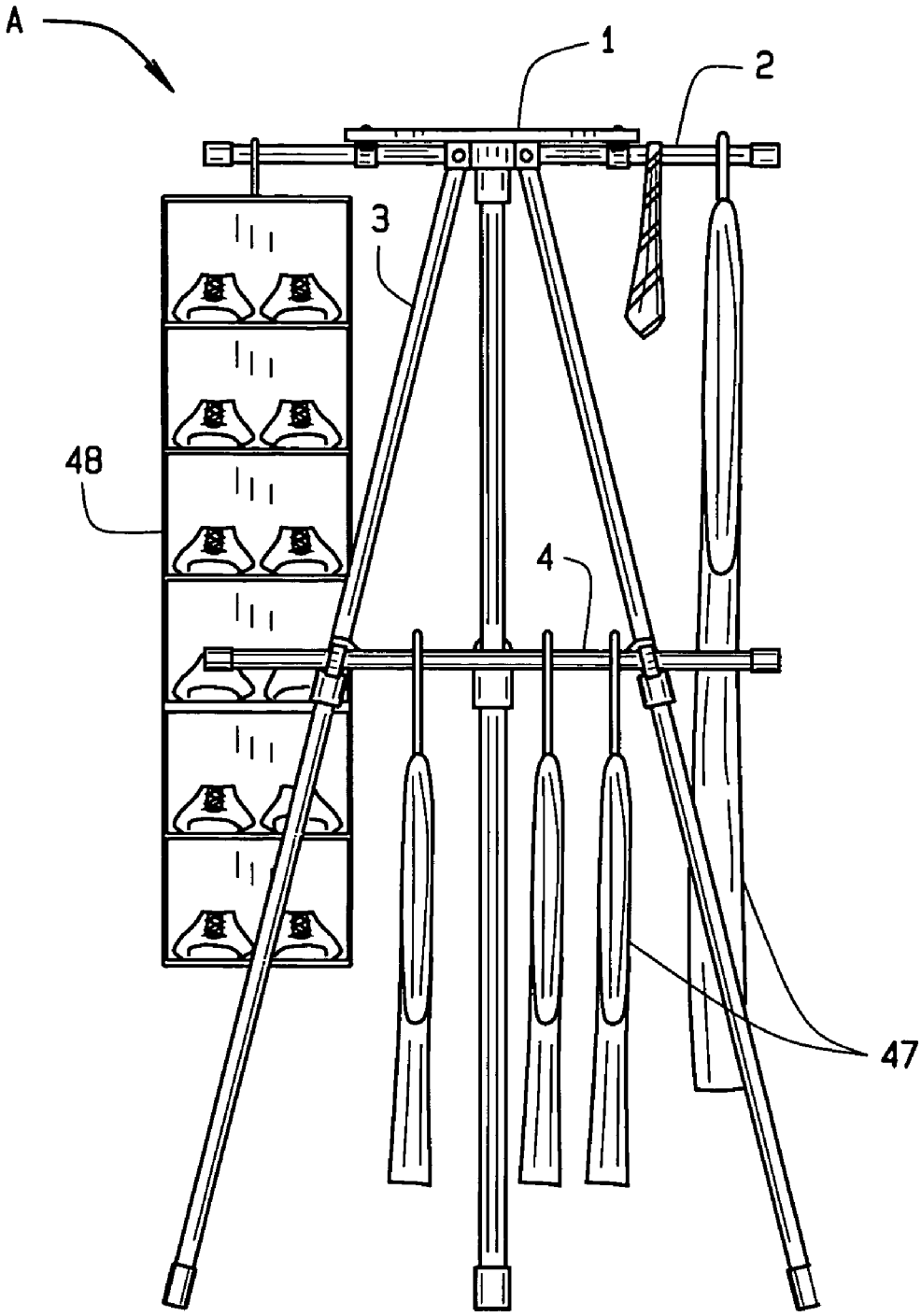
FIG. 1 is a front view of one embodiment of the present invention showing the manner in which clothes and shoes may be stored on the invention.
Figure 2:
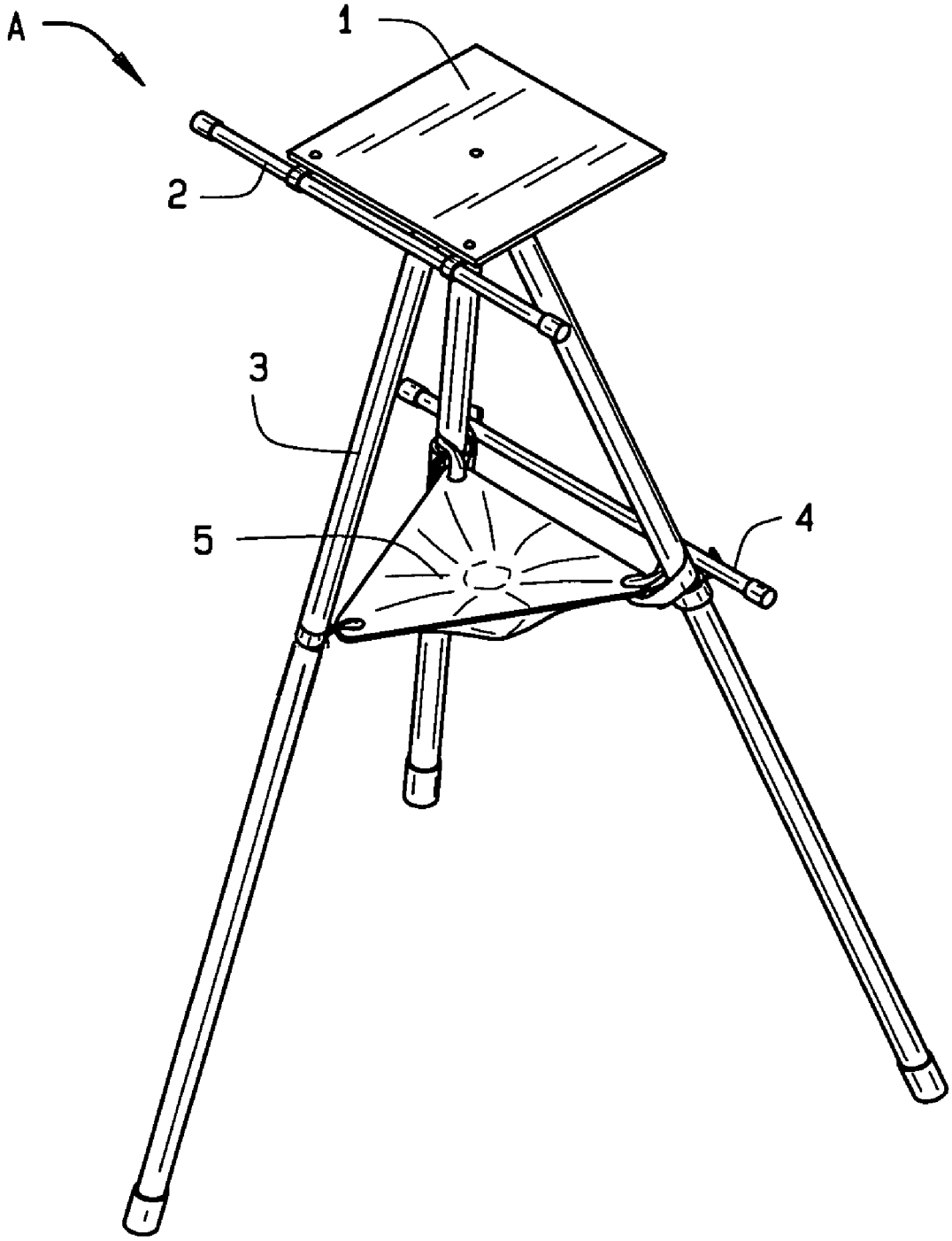
FIG. 2 is a perspective view of one embodiment of the present invention.

Referring now to FIG. 1 and FIG. 2, a portable garment rack A is shown. The portable garment rack A includes an accessory shelf 1, an upper hanger bar 2, an intermediate hanger bar assembly 4, an intermediate accessory shelf 5, and a support assembly 3. FIG. 1 shows one manner in which hanging clothes 47 and/or shoe racks 48 may be placed on the upper hanger bar 2 or the intermediate hanger bar 4.

Figure 3:
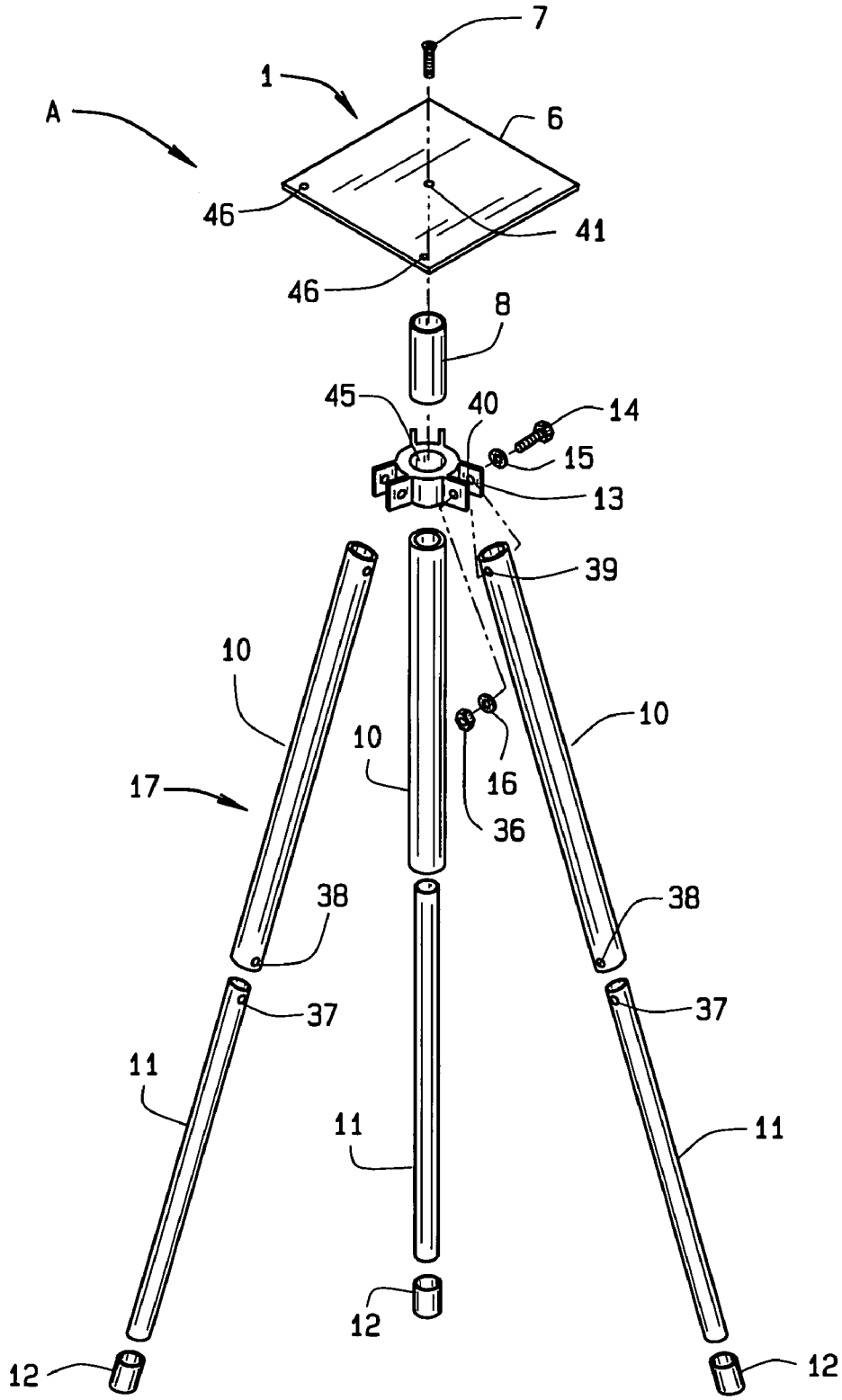
FIG. 3 is a perspective view of one embodiment of the present invention showing an exploded view of the support assembly.

The support assembly 3 (FIG. 2 and FIG. 3) in the present embodiment includes three leg assemblies 17 arranged as a tripod. Each leg assembly includes an upper leg 10 and a lower leg 11. The lower leg 11 has a spring loaded detent pin 37 that engages with a detent hole 38 in the upper leg 10. In its extended position, the leg assembly 17 is held extended by the engagement of the spring loaded detent pin 37 with the detent pin opening 38 in each of the upper legs 10. To collapse the support assembly 3 for storage or transportation, the spring loaded detent pin 37 is depressed until it is lower than the detent pin opening 38 and the lower leg 11 is telescoped into the upper leg 10. While any detent pin may be used to restrict the telescoping of the extended legs, the detent pin 37 of the present embodiment includes a circumferential ridge that acts to engage with the edge of the lower leg 11 when the lower leg is extended. Each of the three leg assemblies 17 are attached to the pivot 13 with a bolt 14, a washer 15, a lock washer 16, and a nut 36 inserted into the leg mounting holes in the upper leg 10 and the pivot mounting openings 40. Additionally, each of the lower legs 11 of the three assemblies 17 includes a foot 12 installed onto the lower end of the lower leg 11. Each foot 12 is made from a product that will inhibit the portable garment rack A from marring a flooring surface upon which the portable garment rack A is resting. In an alternative embodiment of the present invention, the foot 12 can include a rolling element that allows the portable garment rack A to be rolled across a floor.

In the present embodiment, the upper legs 10 and the lower legs 11 are made from a lightweight metal such as aluminum tubing. Other materials such as steel, plastic, or wood may also be used provided the support assembly is made strong enough to support the expected weight and the overall weight of the portable garment rack A is not detrimental to the easy carrying and transport of the portable garment rack A. It will also be appreciated that while the embodiment shown herein uses three legs in a tripod arrangement, the number of legs used can be varied to meet the specific requirements of use for the portable storage rack A. For example, it may be necessary to use four legs to provide additional directional support for the portable storage rack A.

Figure 6:
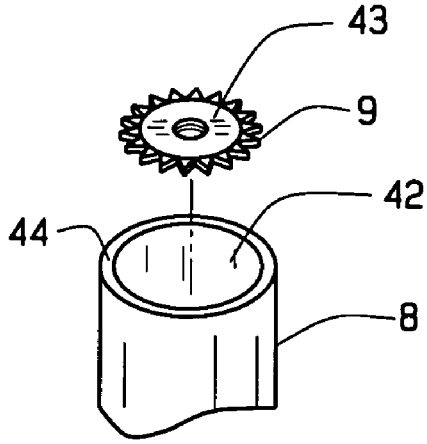

The accessory shelf 1 comprises an upper plate 6 installed onto a vertical guide tube 8 with a flat head screw 7. The flat head screw 7 is installed through upper plate opening 41 and into a captivated nut 9 (FIG. 6) that is installed into the inside diameter 42 of the vertical guide tube 8 such that the horizontal surface 43 of the captivated nut 9 is generally flush with the rim 44 of the vertical guide tube 8. After the assembly of the accessory shelf 1 is complete, the accessory shelf 1 is installed into the opening 45 (FIG. 3) of the pivot 13, with the vertical guide tube 8 sliding through the opening 45 until the upper plate comes to rest on the pivot 13.

Figure 4:
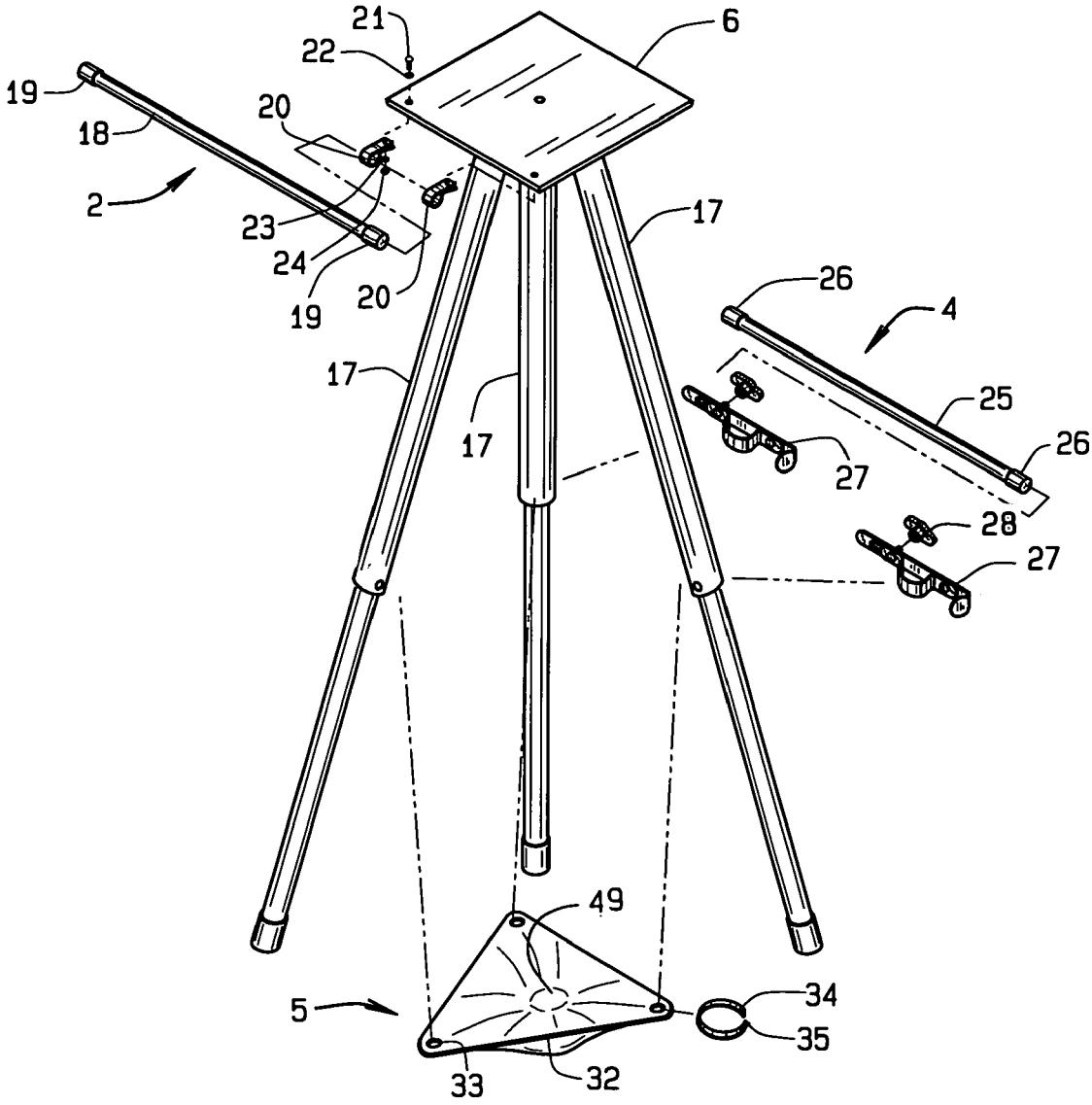
FIG. 4 is a perspective view of one embodiment of the present invention showing an exploded view of the upper hanger bar, the intermediate hanging bar, and the intermediate accessory shelf.

The upper hanger bar 2 (FIG. 4) is attached to the upper plate 6 of the accessory shelf 1 with two mounting down straps 20, two bolts 21, two washers 22, two lock washers 23, and two nuts 24. The upper hanger bar 2 includes a bar 18 and two covers 19 with the covers 19 mounted to each of the two ends of the bar 18. The upper plate 6 has two mounting openings 46 for the installation of the two mounting straps 20. While in the present embodiment the upper hanger bar 2 is installed such that the midpoint of the length of the upper hanger bar 2 is aligned with the centerline of the accessory plate 1, the upper hanger bar 2 may be located at any position within the mounting straps 20.

The intermediate hanger bar 4 (FIG. 4) rests on two bar holders 27 mounted onto two of the leg assemblies 17. The intermediate hanger bar 4 includes a bar 25 and two covers 26, with each cover 26 located at one of the two ends of the bar 25. Each bar holder 27 is mounted onto the leg assembly 17 with a winged retainer 28. By loosening and tightening the winged retainer 28, the bar holders 27 may positioned at various heights on the leg assembly 17. The bar holders 27 are located on each of the two leg assemblies 17 such that when the intermediate hanger bar 4 is resting on the two bar holders 27, the two bar holders 27 are located between the covers 26 located at each end of the bar 25. It will be appreciated that while this location is preferred in the present embodiment, the vertical location of the intermediate hanger bar 4 can be adjusted up or down as long as the intermediate hanger bar 4 can rest on the two bar holders 27.

The intermediate accessory shelf 5 (FIG. 4) includes a generally triangular-shaped flexible material 32 having one of three grommets 33 mounted near each apex of the triangular shape. The design of the intermediate accessory shelf 5 in the current embodiment also includes a concave area 49 near the center of the intermediate accessory shelf. This concave area 49 tends to allow any items placed on the intermediate accessory shelf 5 to move toward the center of the shelf thereby enhancing the ability of the shelf to hold the small items. Each corner of the intermediate accessory shelf 5 is mounted to a leg assembly 17 with one of three straps 34 that has been inserted through the grommet 33 and around the outer circumference of the leg assembly 17. The shape of the intermediate accessory shelf 5 is also generally concave, with the concave surface facing upward toward the pivot 13. The concave nature of the intermediate accessory shelf 17 works to retain any objects placed upon it.

Once assembled, the portable garment rack A is capable of storing a wide variety of clothes and grooming supplies. The upper hanger bar 2 (FIG. 1) on the accessory shelf 1 can carry long clothes such as dinner dresses, formals, ties, and belts, and either simultaneously or alternatively, shoe holders can also be hung from the upper hanger bar. The accessory shelf 1 is large enough to hold large or small hats, boxes, makeup boxes, or mirrors. The design of the accessory shelf 1 is also strong enough to hold other items. The intermediate accessory shelf 5 is best used to store grooming supplies such as lipstick, brushes, combs, and earrings, as well as other loose items such as loose change. The intermediate hanger bar 4 is the primary hanging bar and is used for hanging shorter length items such as shirts and blouses, or suits with pants folded inside.

Figure 5:
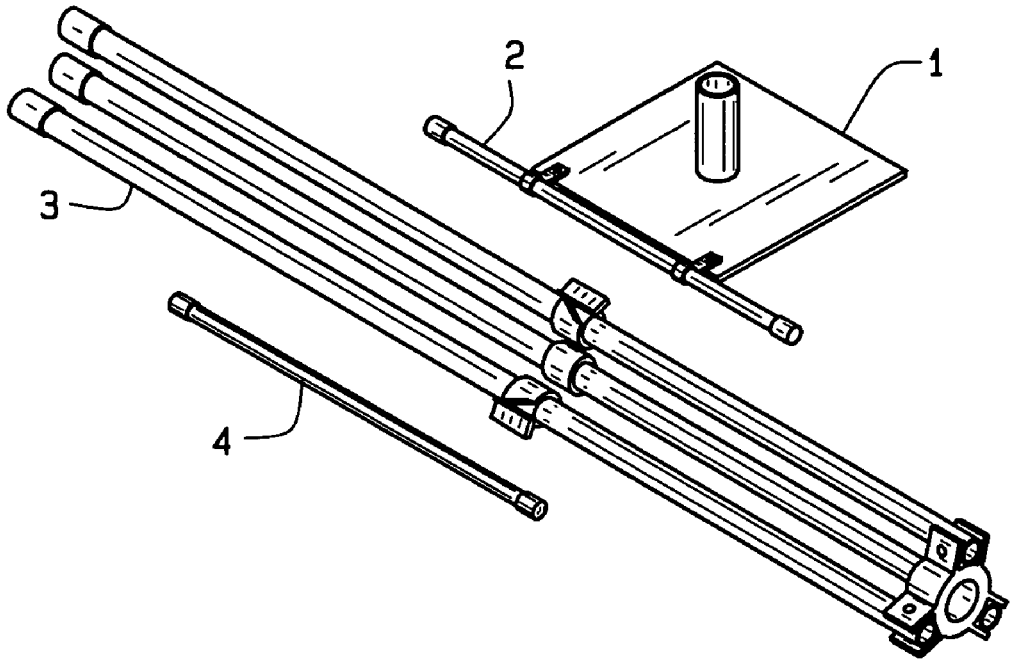
FIG. 5 is a perspective view of one embodiment of the present inventions showing the invention collapsed for transportation or storage; and, FIG. 6 is an exploded view of the guide pipe of one embodiment of the present invention.

When the portable garment rack A must be stored or transported, the intermediate hanger bar 4 (FIG. 5) and accessory shelf 1 are removed from the support assembly 3 without the need for any disassembly. Each of the lower leg assemblies 11 is then telescoped into the associated upper leg 10 such that the leg assemblies 17 are as short as possible. The leg assemblies 17 are then brought together around the pivot 13. The three straps 34 may be unsnapped and removed from the grommets 33 of the intermediate flexible shelf 5 to remove the flexible shelf 5 from the leg assemblies 17, or the intermediate flexible shelf 5 may remain in position attached to the leg assemblies 17. All of the components can then be placed into a carrying bag.

While the above description describes various embodiments of the present invention, it will be clear that the present invention may be otherwise easily adapted to fit any configuration where a portable garment rack having the ability to collapse for transport is required.

As various changes could be made in the above constructions without departing from the scope of the invention, it is intended that all matter contained in the above description or shown in the accompanying drawings shall be interpreted as illustrative and not in a limiting sense.

What is claimed is:

1. A portable garment rack comprising:

a support assembly;

an accessory shelf located on the support assembly;

an upper hanger bar attached to the accessory shelf;

an intermediate hanger bar assembly attached to the support assembly; and an intermediate accessory shelf attached to the support assembly, wherein the intermediate accessory shelf is made from a flexible material.

2. The portable garment rack of claim 1 wherein the support assembly comprises three leg assemblies and a pivot arranged as a tripod.

3. The portable garment rack of claim 2 wherein each leg assembly includes an upper leg and a lower leg.

4. The portable garment rack of claim 3 wherein the lower leg has a spring loaded detent pin that engages with a detent hole in the upper leg.

5. The portable garment rack of claim 4 wherein when the leg assembly is in its extended position, the leg assembly is held extended by the engagement of the spring loaded detent pin with the detent pin opening in each of the upper legs.

6. The portable garment rack of claim 5 wherein the collapsing of the support assembly for storage or transportation is accomplished by depressing the spring loaded detent pin in each of the three lower legs until the detent pin is lower than the detent pin opening in the upper leg, and the lower leg is then telescoped into the upper leg.

7. The portable garment rack of claim 6 wherein each of the lower legs of the three assemblies includes a foot installed onto a lower end of the lower leg.

8. The portable garment rack of claim 7 wherein each of the three leg assemblies are attached to the pivot with a bolt, a washer, a lock washer, and a nut inserted into a leg mounting openings in each of the upper legs 10 and one of a set of mounting openings in the pivot.

9. The portable garment rack of claim 8 wherein each foot is made from a product that will inhibit the portable garment rack from marring a flooring surface upon which the portable garment rack is resting.

10. The portable garment rack of claim 9 wherein the upper legs and the lower legs are made from one of either a metal material, a wooden material, or a plastic material.

11. The portable garment rack of claim 10 wherein the upper legs and the lower legs are made from aluminum tubing.

12. The portable garment rack of claim 11 wherein the accessory shelf comprises an upper plate installed onto a vertical guide tube with a fastener installed through an upper plate opening and into a captivated nut that is installed into an inside diameter of the vertical guide tube such that a horizontal surface of the captivated nut is generally flush with a rim of the vertical guide tube.

13. The portable garment rack of claim 12 wherein the accessory shelf is installed into the opening of the pivot by sliding the vertical guide tube through a opening of the pivot until the upper plate comes to rest on the pivot.

14. The portable garment rack of claim 13 wherein the upper hanger bar is attached to the upper plate of the accessory shelf with two mounting down straps, two bolts, two washers, two lock washers, and two nuts, wherein the upper plate has two mounting openings for the installation of the two mounting straps.

15. The portable garment rack of claim 14 wherein the upper hanger bar includes a bar and two covers with one of each of the two covers mounted to each of the two ends of the bar.

16. The portable garment rack of claim 15 wherein the intermediate hanger bar rests on two bar holders, wherein each of two adjacent leg assemblies have one bar holder mounted thereon.

17. The portable garment rack of claim 16 wherein the intermediate hanger bar includes a bar and two covers, with each cover located at one of the two ends of the bar.

18. The portable garment rack of claim 17 wherein each of the two bar holders is mounted onto one of the leg assemblies with a winged nut, and wherein each of the two bar holders are located on the two leg assemblies such that when the intermediate hanger bar is resting on the two bar holders and the two bar holders are between the two covers.

19. The portable garment rack of claim 18 wherein the intermediate accessory shelf includes a generally triangular-shaped flexible material having three corners and three grommets, with one of three grommets mounted near an apex of each of the three corners, and wherein the intermediate accessory shelf includes a generally concave area located substantially near a center of the triangular-shaped flexible material.

20. The portable garment rack of claim 19 wherein each of the three corners of the intermediate accessory shelf is mounted to a leg assembly by one of three straps that has been inserted through the grommet and around an outer circumference of the leg assembly.

* * * * *